United States Patent [19]

McRoskey et al.

[11] 4,356,941

[45] Nov. 2, 1982

[54] SQUEEZE-TYPE DISPENSER FOR POWDERED MATERIALS

[75] Inventors: John W. McRoskey, Los Angeles; Delbert D. Swartz, Torrance, both of Calif.

[73] Assignee: Republic Tool & Manufacturing Corporation, Carlsbad, Calif.

[21] Appl. No.: 150,778

[22] Filed: May 19, 1980

[51] Int. Cl.[3] ..... B65D 37/00

[52] U.S. Cl. ..... 222/632; 222/211

[58] Field of Search ..... 222/209, 211, 212, 213, 222/215, 376, 402.18, 402.19, 464, 632, 633

[56] References Cited

U.S. PATENT DOCUMENTS

| | | | |
|---|---|---|---|
| 1,573,334 | 2/1926 | Thomas | 222/212 X |
| 2,390,871 | 12/1945 | Conway | 222/402.18 X |
| 2,981,444 | 4/1961 | Root | 222/211 X |
| 3,260,421 | 7/1966 | Rabussier | 222/464 X |
| 3,499,583 | 3/1970 | Hauer et al. | 222/211 |
| 4,091,966 | 5/1978 | Laauwe | 222/211 |

*Primary Examiner*—F. J. Bartuska

*Attorney, Agent, or Firm*—Whann & McManigal

[57] ABSTRACT

A squeeze-type dispenser for a powdered material, commonly known as a puffer duster, for producing a cloud of appropriate treating powder for the control of insects and other infestations, and for similar purposes, in which a squeeze container has a wall that is deformable to decrease the volume of the container and produce a pressurized air source therein to force a stream of air through a passage to a connected nozzle, the passage comprising a thin walled tube connected with the nozzle and having restricted inlet openings so arranged that in any position of a partially filled container, there will be at least one opening positioned in the powder and another opening positioned in an air space within the container, whereby movement of the pressurized air to the nozzle will carry powder from the container to a tube section which is devoid of openings and wherein the powder and air will be mixed in such a manner that the powder will be ejected from the nozzle in the form of a dusting cloud. The container is transversely so shaped as to induce its being manually gripped in an oriented operating position in which the nozzle discharge will be directed away from the user.

14 Claims, 5 Drawing Figures

SQUEEZE-TYPE DISPENSER FOR POWDERED MATERIALS

PRIOR ART

In the prior art, there are a number of dispensers for use and dispensing of powders for the treatment of insects and other types of infestations, and in which the dust is ejected through a nozzle by means of a pressurized stream of air or other gas. The closest art known to applicants are the following patent Nos.:

535,439—Mar. 12, 1895
1,609,674—Dec. 7, 1926
2,331,842—Oct. 12, 1943
2,981,444—Apr. 25, 1961
3,054,210—Sept. 18, 1962
3,069,098—Dec. 18, 1965
3,223,389—Dec. 14, 1965
3,499,582—Mar. 10, 1970
3,545,488—Dec. 8, 1970
4,091, 966—May 30, 1978

BACKGROUND OF THE INVENTION

The present invention relates generally to powder dusters.

It has been generally known for many years, as exemplified by U.S. Pat. No. 535,439, dated Mar. 12, 1895 and U.S. Pat. No. 1,609,674, dated Dec. 7, 1926, to provide insect dusters and sprayers of the type in which wall portions of a bellows or container could be manually deformed to compress air within the container to force a powder therein through an opening or openings of a discharge tube and emitted from an exterior end of the tube or a connected nozzle into the atmosphere for dusting purposes. Such structures were at most quite crude, and operatively leave much to be desired. For example, these prior devices were not adapted to operate effectively in all positions of orientation, and more particularly did not operate effectively when the container was only partially filled with the powder.

Later patents, as exemplifid by U.S. Pat. No. 2,981,444, dated Apr. 25, 1961 and U.S. Pat. No. 4,091,966, dated May 30, 1978, disclose squeeze-type dispensers which attempt to overcome many of the problems associated with the earlier devices, and disclose embodiments which allegedly operate in either an upright or inverted tilted position. In practice, however, it has been found that there are positions in which these known devices did not operate satisfactorily, and particularly, when the containers were only partially filled with powder.

Both of the above noted patents, recognize the existing problem in which compaction of the powder in the areas of the openings in the discharge tube produced a deleterious effect which seriously limited the operative effectiveness of the device. Thus, in attempting to solve this and other problems inherent in the known devices, the patentees have also provided supplemental intake nozzle passages for communicating with the air in the top end of the container, when operating in a substantially upright position.

More specifically, the first of the above noted patents utilizes an elongated discharge tube provided with a plurality of longitudinally spaced openings therein, the tube being connected to a nozzle within which it communicates with a nozzle mixing chamber that is also in communication through one or more supplemental passages with the adjacent upper end interior of the container.

The second of the above noted patents (Pat. No. 4,091,966) also utilizes a supplemental passage for connecting the nozzle passage with the upper end interior of the container. The discharge tube is in this case formed by interconnected parallel tubes having their lower ends connected by a fitting which provides a relatively sharp U-bend with a single orifice at the bottom of the U-bend portion. The upper end of one of the parallel tubes is connected with a nozzle, while the other parallel tube has its upper end positioned in communication through an unrestricted end opening with the upper end interior of the container.

Applicants have discovered through exhaustive tests on squeeze-type powder dispensers, constructed after the manner disclosed in the above U.S. Pat. Nos. 2,981,444 and 4,091,966, that the successful operation of squeeze-type powder dispenser particularly when in tilted or inverted positions or only partially filled with powder, is affected by a number of important factors which briefly include, for example:

1. The relative diameter of a nozzle discharge opening, location and arrangement of the restrictive openings at the inner end of the discharge tube and at the U-bend portion of the tube, and by the number of the restricted openings and their respective locations along the discharge tube,
2. The provision of a discharge tube end portion at the nozzle connected end of the discharge tube, which is devoid of restrictive openings and provides a mixing chamber in which the powder and air will be mixed in such a manner that the powder will be ejected from the nozzle in the form of a dusting cloud,
3. The configuration of the container so as to retain the discharge tube in a predetermined operative position within the container, during all orientated positions of operation, and
4. A further consideration resides in the unique transverse configuration of the container to induce its being manually gripped in a natural manner during use so that the nozzle discharge will be directed away from the user.

The present invention is more specifically directed to a squeeze-type dispenser which is designed and constructed to take maximum advantage of the foregoing factors and considerations in overcoming the existing problems an disadvantages which are inherent in the presently known and available devices for dispensing of powder in a cloud formation.

SUMMARY OF THE INVENTION

The present invention is more specifically concerned with improvements in the construction and operation of powder dusters of the squeeze-type to get far superior results to those of the prior art.

Having in mind the inherent disadvantages and undesirable operating characteristics of the currently available powder dusting devices, it is one object of the present invention to provide a simple, efficient, and durable squeeze-type powder duster device which will operate effectively in its various positions of its orientation.

A further object resides in the provision of a powder dispenser of the squeeze-type in which a single continuous discharge tube is looped to provide a U-shaped bend portion that is retained in a predetermined orientation within the deformable container, one end of the tube being connected to a nozzle and the other end or closed end being in communication with the interior at the upper end of the container, and in which restrictive openings are provided at the other end part of the discharge tube and in or very close to the U-bend portion in such locations that, in any oriented position of operation, there will be at least one restrictive opening in communication with a powder supply area and another restrictive opening will be in communication with an air supply area within the container, the U-bend portion providing a trap to minimize spilling of the powder.

A further object is to provide a squeeze-type powder dispenser according to the previous object in which the restrictive openings in the U-bend portion of the discharge tube are positioned on opposite sides of the U-shaped bend and on opposite sides of the longitudinal axis of the container, and in which the end of the discharge tube that is connected to the nozzle is devoid of openings and forms a mixing chamber that prevents either air or powder exiting from the nozzle prior to an intermixing thereof.

A further object resides in the provision of a powder dispenser of the squeeze-type in which a deformable container mounts a directive nozzle at one end, and in which the container is constructed transversely to provide a configuration that is so shaped as to induce its being manually gripped in an oriented position such that the nozzle discharge will be directed away from the user.

A still further object is to provide a powder dispenser of the squeeze-type having a deformable container, and which utilizes a looped discharge tube within the container the container being formed with a generally longitudinally extending side channel for receiving a portion of the tube loop and anchoring it in a predetermined position within the container in which the plane of the loop extends substantially diametrically of the container.

Another object is to provide a powder dispenser of the squeeze-type which in its preferred form utilizes a thin walled discharge tube having a length of substantially 18 inches, and internal diameter of substantially 0.200 of an inch, and a wall thickness of substantially 0.040 of an inch, the tube being connected to a nozzle having a discharge orifice of substantially 0.105 of an inch, and with restrictive wall openings in the tube having a diameter of substantially 0.050 of an inch.

It is also an object to provide a powder dispenser according to the foregoing object in which the restrictive openings are arranged at spaced locations longitudinally of the discharge tube.

It is a further object of our invention to provide a powder dispenser of the class described in which the container is provided with a longitudinal trough or channel along one side thereof in which at least one restricted opening in the discharge tube will lie in said channel so that when said powder dispenser is in an inclined position and where there is a small amount of powder in the container, this powder will move into the longitudinal channel and be removed therefrom, thus exhausting a maximum amount of powder.

Further objects and advantages of the invention will be brought out in the following part of the specification, wherein detailed description is for the purpose of fully disclosing a preferred embodiment of the invention without placing limitations thereon.

BRIEF DESCRIPTION OF THE DRAWINGS

Referring to the accompanying drawings, which are for illustrative purposes only.

DESCRIPTION OF A PREFERRED EMBODIMENT

Figure 1:
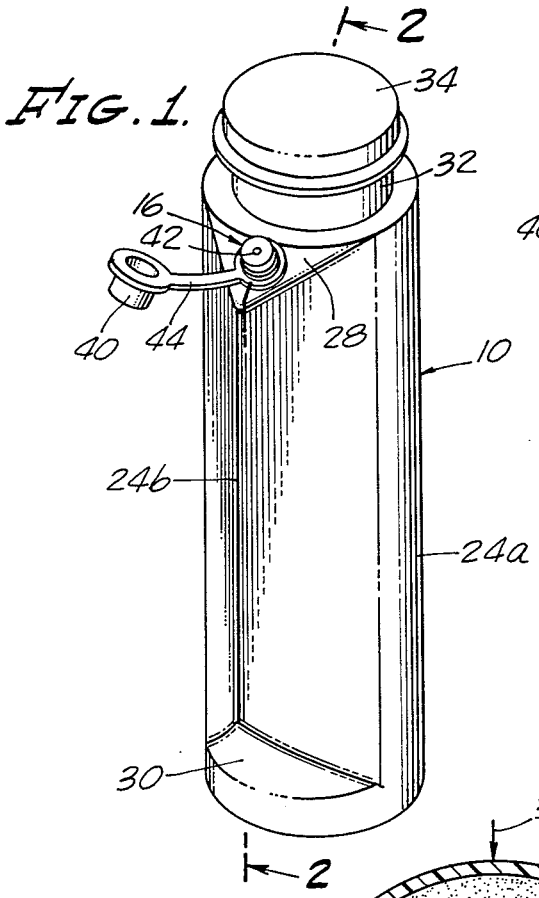
FIG. 1 is a perspective view of a powder dispenser embodying the features of the present invention.

Referring more specifically to the drawings, for illustrative purposes, the powder dispenser of the herein described invention is illustrated as comprising a hollow container 10 of the squeeze-type for the reception of a dusting powder as generally indicated by the numeral 12. A discharge tube 14 is positioned within the container and has one end in connection with a nozzle 16. The tube 14 extends downwardly over to the side of the container opposite from the nozzle 16, makes a bend at the bottom of the container and extends upwardly along the side of the container on which the nozzle is positioned. The upper end of the tube extends to the right to the side of the container opposite from the nozzle and the end thereof engages an end wall of the container. The tube is made from a straight tubular member which is flexible and tends to maintain its straight position. When inserted in the container, the tendency of the tube to straighten conveniently holds the tube in the position shown in the drawings and particularly in FIG. 2.

Figure 2:
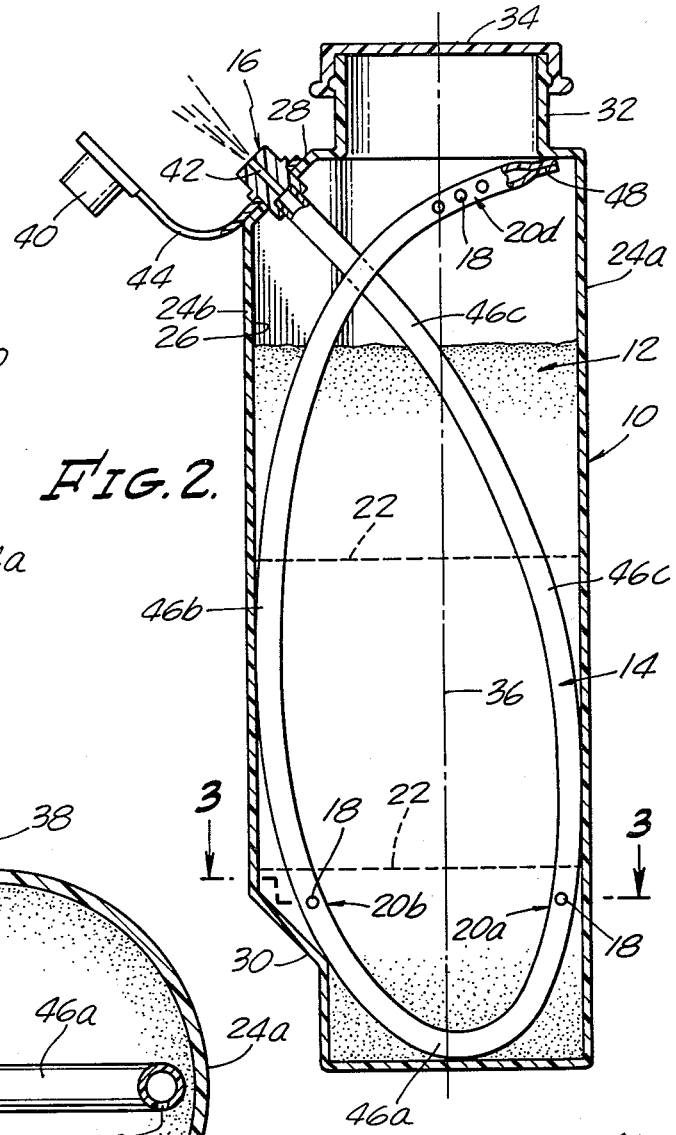
FIG. 2 is an enlarged vertical transverse sectional view, taken substantially on line 2—2 of FIG. 1, in the direction of the arrow and showing the nozzle in section and the discharge tube in full lines.
Figure 4A:
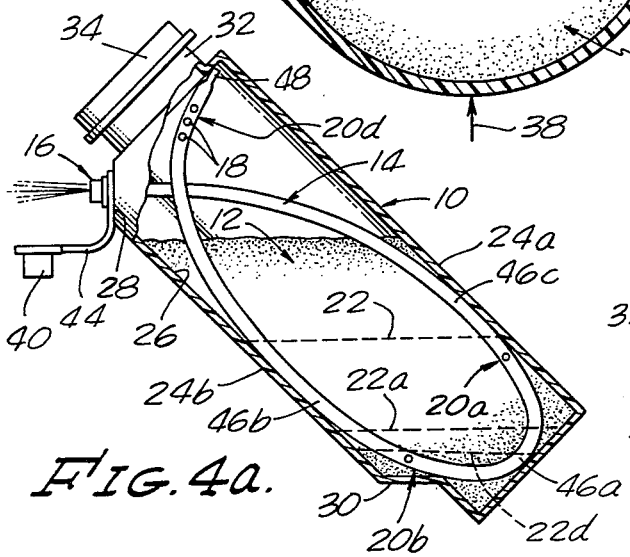
FIG. 4*a* is a view showing the dispenser in an operative position inclined from the upright position shown in FIG. 2, portions being cut away to show the relationship of the discharge tube restricted openings with respect to the powder and air supplies within the container.
Figure 4B:
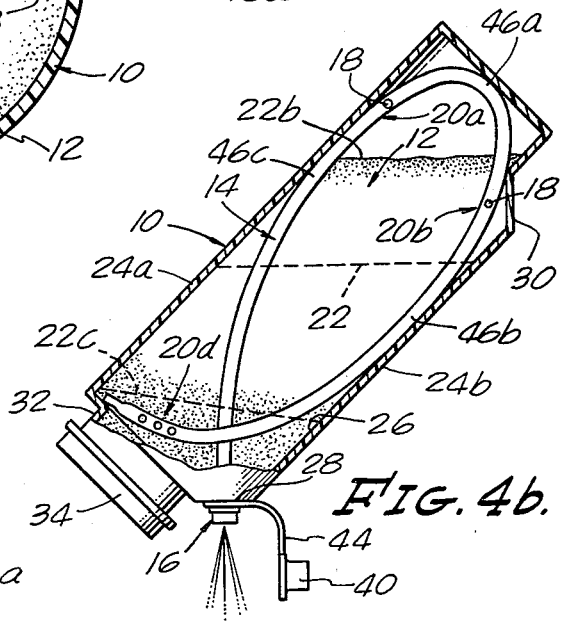
FIG. 4*b* is a similar view for an operative position in which the container is in a generally inverted and downwardly inclined position.

The discharge tube is closed at the end 48 and is provided with a series of restrictive opening means in the form of restrictive openings 18, longitudinally positioned in spaced relation along the tube 14, the positions of the openings being indicated respectively by the numerals 20*a*, 20*b* and 20*d*. In the form of the invention disclosed, there is a single opening at positons 20*a* and at 20*b*, and three openings at 20*d*. As will hereinafter be more specifically described, the restrictive openings 18 are so positioned along the discharge tube 14 that during any operative orientation of the container, (which is at least partially filled with the powder 12) there will at all times be at least one restrictive opening 18 positioned in a powder-containing space, and one restrictive opening 18 positioned in an air-containing space within the container so that when the container is deformed by the manual application of a squeezing pressure against the side walls thereof, the increased air pressure within the container will operate to force powder and air into and through the discharge tube 14 and through the connected nozzle 16 in a manner to form and eject a powder cloud irrespective of the operative orientation of the container. This is the operation which occurs whether the container is in an upright, inverted or tilted position. Also such an operation is effective even though the level of the powder within the container is significantly reduced as indicated by the dashed line 22 in the different container positions as shown in FIGS. 2, 4*a*, and 4*b*. The container 10 may be made of any of the usual flexible plastics commonly utilized for squeeze bottles, and is constructed so as to provide a generally cylindrical main sidewall portion 24*a* and an integrally formed secondary sidewall portion 24*b* of generally V-shaped transverse configuration, and which provides a longitudinally extending channel 26 that extends between an inclined endwall 28 at the top end of the container and an inclined endwall 30 at the bottom end of the container.

Figure 3:
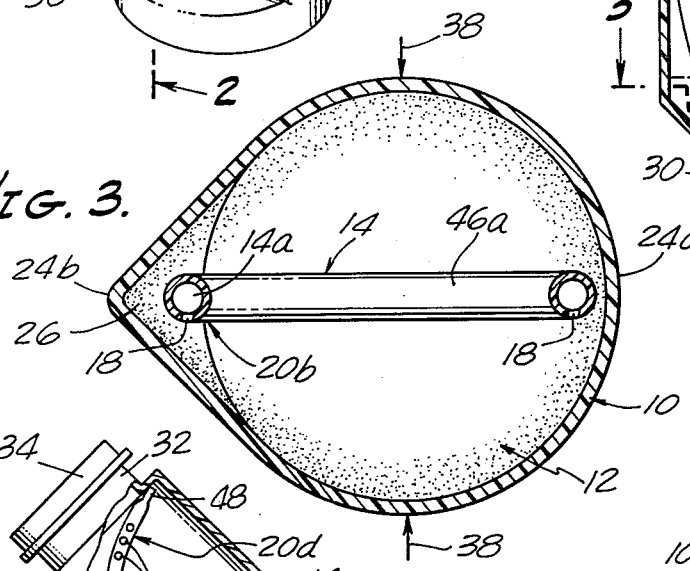
FIG. 3 is a further enlarged transverse sectional view, taken substantially on line 3—3 of FIG. 2.

The top end of the container is formed to provide an extended charging neck portion 32 which is adopted to releasably receive a closure cap 34. As thus arranged, the neck portion 32 is coaxial with the longitudinal axis 36 of the cylindrical main sidewall portion 24*a*. Since the nozzle is mounted on the inclined endwall 28, the powder cloud will be emitted from the nozzle in an angular direction towards the apex of the V-shaped secondary sidewall portion 24*b*. Thus, the transverse configuration of the cylindrical main sidewall portion 24*a* and the secondary sidewall portion 24*b* is such as to induce its being manually gripped in an oriented operating position in which the nozzle discharge will be directed away from the user, and in which opposite sides of the main sidewall portion 24*a* will be properly positioned for squeezing in the direction of the opposed arrows 38, as shown in FIG. 3. For convenience, a plastic cap 40 is arranged to fit over the projecting end of the nozzle 16 to close nozzle orifice 42, when desired, this cap being attached by means of an integrally formed flexible plastic strap 44.

Referring again to FIGS. 2 and 3, the discharge tube 14 is formed into an elongate loop which has a U-bend portion 46*a* which is positioned in the bottom of the container 10, a loop side-portion 46*b* which is seated in and extends along the channel 26 and terminates at a sealed pinched end 48 which is positioned in the top end of the container. A loop side portion 46*c* of the tube 14 extends to and terminates at an end connected with the nozzle 16.

A feature of the arrangement just described is that the channel 26 serves to anchor and orient the looped discharge tube within the container in a position in which the plane of the loop is oriented diametrically of the cylindrical main sidewall portion 24*a* of the container.

Another important feature of the arrangement is that the loop side-portion 46*c* is devoid of openings between the opening 20*a* and the nozzle. This portion of the discharge tube has no opening to the interior of the container and provides a mixing area or mixing chamber 46*a* and 46*d* in which the air and powder will be thoroughly intermixed prior to being forced from the nozzle 16 as a powder cloud.

The U-bend portion 46*a* of the tube provides a trap which prevents inadvertent spilling of the powder through the nozzle when the container is in an inverted position.

Restrictive openings are placed on opposite sides of the U-bend, there being an opening 18 positioned at 20*a* and an opening positioned at 20*b*. These openings are positioned on the opposite sides of the longitudinal axis 36 of the container near the closed end of the container. The opening 20*b* is positioned in the channel 26 at the closed end of the container. In the nozzle end of the chamber and in a position opposite to the nozzle as indicated by 20*d* are three openings at 18.

Extensive tests have indicated that the interrelationship of the dimensions of the tube 14, its length, wall thickness and diameter, the size of the nozzle orifice, and the size of the restrictive openings 18 and the length of the opening passage as determined by the wall thickness of the tube give much superior results. As exemplary of a preferred construction which has proved very successful in use, detailed dimensions as hereinafter noted have been utilized. For example, the container 10 has a height of 9 inches and a diameter of approximately 2½ inches. The discharge tube 14 is approximately 18 inches in length and is constructed of thin walled tubing to reduce any clogging tendency. The internal diameter of the tubing is 0.200 of an inch. The nozzle opening is 0.100 of an inch. The openings 18 are 0.040 to 0.070 of an inch in diameter.

Each of the opening positions 22*a*, 22*b* and 22*d* show the separate openings 18 at three positions in the tube and in the container. The opening position 22*a* is in the lower part of the container and near the closed end thereof. Directly opposite is the opening position 20*b*. These two opening positions are at opposite sides of the container and on opposite sides of the longitudinal axis 36. The length of the openings 18 is determined by the thickness of the tube wall which is in the form of the invention shown is from 0.040 to 0.050 of an inch. It has been found that by making the length of the openings no longer than the diameter of the openings the tendency of the powder to clog is practically eliminated.

The openings 18 comprise "restrictive openings" or "restrictive opening means". These terms are used in the description and claims to mean that the individual openings are of less cross-sectional area than the area of cross-section of the passage 14*a* in the tube 14. When the container is quickly squeezed, the pressure therein is increased and there will be a pressure drop across all of the openings 18. The pressure within the tube 14 is less than the pressure within the container and this lower pressure in the tube 14 causes a back pressure at all of the openings 18 so that the rate of flow through these restrictive openings from the container into the passage of the tube will be controlled. Because of the nozzle orifice 42, the pressure in the passage 14*a* will be above atmospheric pressure. The air and powder will be thoroughly mixed under pressure in the mixing chamber of the passage 14*a*, and the mixture will then be released to atmospheric pressure through the nozzle orifice 42. The amount of air or powder moving into the tube passage through the openings (depending upon which are in the "air" and which are in the "powder" areas) will be properly proportioned to cause controlled volumes of air and powder to flow into and through the tube passage 14*a* irrespective of the operative position of the container.

In the functioning of the powder dispenser of the present invention, it will be evident from a consideration of FIGS. 2, 4*a* and 4*b* that in any desired operating orientation of the container, squeezing of the container will be increased at all parts of the container, including the air space as well as the space containing the powder. This increase in pressure causes air to flow through the restrictive openings that are positioned in the air supply space, and causes powder to move through any restricted opening that is positioned in the powder supply space.

When the container is in the position as shown in FIGS. 2, 3 and 4*a* the restrictive opening means at 20*a* and 20*b* are below the powder level while the restricted openings at 20*d* are above the powder level. When the container is squeezed, air will flow through the openings of 20*d* and through the tube 14 and toward the nozzle 16. The flow of air will pick up powder which is moved into the tube at the openings 20*a* and 20*b* carrying it toward the exhaust end of the tube. When the air and powder reach the mixing chamber 46*c* of the tube, the air and powder becomes thoroughly and intimately mixed prior to its reaching the nozzle 16. The mixing is so thorough and intimate that the air and powder will be forced outwardly through the nozzle opening 42 in the form of a cloud.

When the container is inverted, such, for example, as shown in FIG. 46 with the powder level at 22*b*, the opening at 20*a* will be in the air portion of the chamber while the openings at 20*b* and 20*d* will be in the Powder area. When the air and powder move past the opening at 20*a*, it passes into and through the mixing chamber where they are throughly mixed and forced out through the nozzle in the form of a cloud. If the level of the powder is at 22*c*, the openings 20*a* and 20*b* will be exposed to air while the opening 22*d* will be exposed to powder. Even at this low level of powder, the operation of the dispenser will still function to produce the powder in the form of a cloud.

Referring back to FIG. 4*a*, when the dispenser is in an upright tilted position as shown, the openings 20*a* and 20*b* will be in the powder area and the openings 20*d* will be in the air space area. However, when the powder level has been reduced so that it is at the level 22*a* in FIG. 4*a*, the opening 20*b* will be in the powder area while the openings 20*a* and 20*d* will be in the air area. It will be noted that the opening 20*b* is in the trough or channel 26 and if the dispenser is tilted slightly more, such as indicated by the broken line 22*d*, almost all of the powder can be dispensed.

While specific dimensions have been given above for a typical operative embodiment, it is to be understood that deviations may be made from these dimensions.

From the foregoing description, it is believed that it will be appreciated that the heretofore outlined objects of the invention will be attained by powder dispenser embodying the described features, and that it provides inherent advantages over prior known devices for the productions of a dusting cloud.

Various modifications may suggest themselves to those skilled in the art without departing from the spirit and scope of the disclosed invention. For example, although the single channel 26 is fully effective and adequate, a channel could be placed at the opposite side of the container and in which the passage forming means or tube could extend. In view of the possible modifications, it is not the desire to be restricted to the specific form shown or uses mentioned except to the extent indicated in the appended claims.

We claim:

1. A squeeze type dispenser for dispensing a uniform cloud of a powder material in any position of the dispenser, the dispenser comprising:

a. a container adapted to be at least partially filled with powder material to be dispensed therefrom, said container having a deformable wall portion whereby, upon deformation, the volume of the container will be reduced, said container having a nozzle end and a closed end, b. a dispensing nozzle at the nozzle end of said container, c. passage forming means within said container having a nozzle portion connected to said dispensing nozzle for delivering an air-powder cloud therefrom, said passage forming means having an intermediate portion connected to said nozzle portion and positioned in the closed end of said container and an end portion having one end thereof closed and the other end thereof connected to said intermediate portion and positioned in the nozzle end of said container, said intermediate portion being in the form of a U-bend of at least 180°, said nozzle and end portions having wall contacting sections thereof which contact said container wall, and d. at first restrictive opening means defined in said end portion, a second restrictive opening means defined in said intermediate portion closely adjacent to said end portion wall contacting section, a third restrictive opening means defined in said intermediate portion closely adjacent to said nozzle portion wall contacting section with said nozzle wall contacting section being located between said third restrictive opening means and said dispensing nozzle so that in any orientation of said container there will be at least one restrictive opening means in communication with powder in said chamber, and one restrictive opening means in communication with air in said container, each restrictive opening means being of less cross-sectional area than the cross-sectional area of a passage formed by said passage forming means so that when said container is squeezed to increase the pressure in said container, there will be a pressure drop across each restrictive opening means between said container and the passage in said passage forming means, said difference in pressure causing a restricted flow of powder and air from the container into the passage, said passage in said passage means being closed from the interior of said container to be maintained out of communication with the interior of said container between said nozzle portion wall contacting section and said dispensing nozzle to define a mixing chamber in which powder and air flowing through said passage forming means thoroughly mix prior to reaching said dispensing nozzle so that the air and powder flowing in said passage forming means produce a uniform mixture of air and powder irrespective of the operating position of said container.

2. A dispenser according to claim 1, in which said container has a longitudinal channel along one side thereof and in which a restrictive opening means is positioned in said channel.

3. A dispenser according to claim 1, in which:

the restrictive opening means of said U-bend are on opposite sides of a central axis of the container.

4. A combination as defined in claim 1 in which there is a longitudinal channel formed along the wall of said container and in which a portion of the said passage forming means extends.

5. A combination as defined in claim 1 in which the end portion of said passage forming means is positioned at a location on the opposite side of said container from said nozzle.

6. A combination as defined in claim 1 in which said nozzle is positioned at the top end of said longitudinal channel.

7. A squeeze-type dispenser for dispensing a uniform cloud of powdered material in any position of the dispenser, the dispenser comprising:

a. a container adapted to be at least partially filled with the powder material to be dispensed therefrom, said container having a deformable wall portion whereby, upon deformation, the volume of the container will be reduced, said container having a nozzle end and a closed end;

b. a dispensing nozzle at the nozzle end of said container;

c. passage forming means within said container having a passage therewithin having a nozzle portion connected to said dispensing nozzle, said passage forming means extending within said container and having an intermediate portion connected to said nozzle portion and positioned in the closed end thereof and an end portion having one end thereof closed and the other end thereof connected to said intermediate portion and positioned in the nozzle end to said container in a position above the powder material level in said container, when said container is in a substantially upright position, said intermediate portion being in the form of a U-bend of at least 180°, said nozzle and end portions having wall contacting sections thereof which contact said container wall; and d. said passage forming means having a first restrictive opening means in said end portion, a second restrictive opening means in said intermediate portion thereof and defined in said intermediate portion closely adjacent to said end portion wall contacting section, a third restrictive opening means defined in said intermediate portion closely adjacent to said nozzle portion wall contacting section with said nozzle wall contacting section being located between said third restrictive opening means and said dispensing nozzle so that in any orientation of said container there will be at least one restrictive opening means in communication with powder in said chamber, and one restrictive opening means in communication with air in said container, there being at least one position of said restrictive opening means in the end portion of said nozzle end of the container which, upon deforming said deformable wall portion of said container, to reduce the volume thereof in a generally upright position of the container, air will be forced through the restrictive opening means in the portion in said nozzle end and powdered material through the restrictive opening means in the portion in said closed end, and vice versa when said container is in a generally inverted position, said passage in said passage means being closed from the interior of said container to be maintained out of communication with the interior of said container between said nozzle portion wall contacting section and said dispensing nozzle to define a mixing chamber in which powder and air flowing through said passage forming means thoroughly mix prior to reaching said dispensing nozzle so that the air and powder flowing in said passage forming means produce a uniform mixture of air and powder irrespective of the operating position of said container.

8. A dispenser according to claim 7, in which:

said restrictive opening means includes openings in longitudinally spaced relation along said passage forming means, said restrictive opening means being so relatively oriented within said container that, in any position of use of the dispenser, there will be at least one restrictive opening means in communication with the powder, and at least one opening means in communication with an air space within the container.

9. A dispenser according to claim 7, in which:

said passage forming means comprises a single continuous length of thin-walled tube.

10. A dispenser according to claim 7, in which:

the container is formed between its ends with a generally cylindrical main sidewall portion; and a second sidewall portion, which forms a longitudinal channel in which a portion of said passage forming means is positioned.

11. A dispenser according to claim 9, in which:

a secondary wall portion of said container defines an elongated channel within and extending generally along one side of the container, said channel being adapted to receive at least a portion of one side of the tube U-bend therein in a manner to hold and orient the U-bend substantially in a plane extending generally diametrically of the container.

12. A combination as defined in claim 11 in which said nozzle is positioned at the nozzle end of said elongated channel.

13. A squeeze type dispenser for a powder material comprising:

a. a container adapted to be at least partially filled with powder material to be dispensed therefrom, said container having a deformable wall portion whereby, upon deformation, the volume of the container will be reduced, said container having a nozzle and a closed end, b. a dispensing nozzle at the nozzle end of the container, c. a passage forming tube within said container having one end connected with said nozzle, and said passage forming tube extending near one wall of the container to the closed end of said container and thereafter extending along an opposite portion of the container wall to the nozzle end of said container, said passage forming tube having restricted opening means in said tube at the area of the closed end of said container and also in said tube on diametrically opposed portions of said tube, (d) said restricted opening means being positioned in said tube so that at least one of said restrictive opening means communicates with air space in the container and another of the restrictive opening means in communication with a powder area, in all operative positions of said dispenser, and (e) there being a longitudinal channel formed in the wall of said container and in which a portion of said passage forming tube lies.

14. The combination as defined in claim 13 in which one of said restrictive opening means lies in said channel.

* * * * *